US006217304B1

(12) United States Patent
Shaw

(10) Patent No.: US 6,217,304 B1
(45) Date of Patent: Apr. 17, 2001

(54) MULTI-ROTOR HELICAL-SCREW COMPRESSOR

(76) Inventor: David N. Shaw, 200 D Brittany Farms Rd., New Britain, CT (US) 06053

( * ) Notice: Subject to any disclaimer, the term of this patent is extended or adjusted under 35 U.S.C. 154(b) by 0 days.

(21) Appl. No.: 09/385,645

(22) Filed: Aug. 27, 1999

Related U.S. Application Data

(63) Continuation-in-part of application No. 09/106,620, filed on Jun. 29, 1998, now abandoned, which is a continuation-in-part of application No. 08/808,470, filed on Mar. 3, 1997, now Pat. No. 5,807,091, which is a continuation of application No. 08/550,253, filed on Oct. 30, 1995, now Pat. No. 5,642,992.

(51) Int. Cl.[7] ..... F04C 18/16; F04C 29/02
(52) U.S. Cl. ..... 418/100; 418/152; 418/197
(58) Field of Search ..... 418/97, 100, 152, 418/197, 201.1

(56) References Cited

U.S. PATENT DOCUMENTS

| | | | | |
|---|---|---|---|---|
| 2,481,527 | * | 9/1949 | Nilsson | 418/197 |
| 2,652,192 | * | 9/1953 | Chilton | 418/197 |
| 2,868,442 | * | 1/1959 | Nilsson | 418/152 |
| 4,515,540 | * | 5/1985 | Pillis | 418/97 |
| 4,776,779 | * | 10/1988 | Crump | 418/197 |
| 5,165,881 | * | 11/1992 | Wicen | 418/152 |
| 5,653,585 | * | 8/1997 | Fresco | 418/100 |

FOREIGN PATENT DOCUMENTS

| | | | | |
|---|---|---|---|---|
| 2409554 | * | 9/1975 | (DE) | 418/152 |
| 648055 | * | 12/1950 | (GB) | 418/197 |
| 60-56104 | * | 4/1985 | (JP) | 418/100 |
| 4-203383 | * | 7/1992 | (JP) | 418/152 |

* cited by examiner

*Primary Examiner*—John J. Vrablik
(74) *Attorney, Agent, or Firm*—Cantor Colburn LLP

(57) ABSTRACT

A compressor in accordance with the present invention includes a male rotor which is axially aligned with and in communication with two female rotors. The male rotor is driven by a motor, in other words the male rotor is the drive rotor. The male rotor has a plurality of lobes which intermesh with a plurality of flutes on each of the female rotors. The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, cooling and lubrication. The positioning of the female rotors on opposing sides of the male rotor balances the radial loading on the male rotor thereby minimizing radial bearing loads. The interface velocity between the male and female rotors during operation is low, whereby damage suffered as a result of lubrication loss is reduced. The compressor includes a housing having an inlet housing portion, a main housing portion and a discharge housing portion. An induction side plate and a discharge side plate are mounted on the male rotor. The outside diameter of the induction plate is equal to the root diameter of the male rotor. The outside diameter of the discharge plate is equal to the crest diameter of the male rotor. These plates serve two purposes, to secure the male rotor components and to equalize suction pressure at both ends of the male rotor, thereby virtually eliminating the thrust loads. Discharge porting is defined in the discharge housing portion wherein trap pocket relief is provided.

34 Claims, 17 Drawing Sheets

MALE PITCH DIA. RATIO = 1.5
NUMBER OF MALE TEETH = 12

MULTI-ROTOR HELICAL-SCREW COMPRESSOR

This is a continuation-in-part of copending U.S. patent application Ser. No. 09/106,620 filed on Jun. 29, 1998, now abandonded, which is a continuation-in-part of copending U.S. patent application Ser. No. 08/808,470 entitled MULTI-ROTOR HELICAL-SCREW COMPRESSOR filed Mar. 3, 1997 filed by David N. Shaw, now U.S. Pat. No. 5,807,091 which is a continuation of U.S. patent application Ser. No. 08/550,253 entitled MULTI-ROTOR HELICAL-SCREW COMPRESSOR filed Oct. 30, 1995 filed by David N. Shaw, now U.S. Pat. No. 5,642,992.

BACKGROUND OF THE INVENTION

The present invention relates to helical screw type compressors. More specifically, the present invention relates to a multi-screw compressor having, e.g., a male rotor and at least two female rotors.

Helical type compressors are well known in the art. One such helical compressor employs one male rotor axially aligned with and in communication with one female rotor. The pitch diameter of the female rotor is greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry is shown in FIG. 1 herein, labeled prior art. Referring to FIG. 1 herein, a cross sectional view of a male rotor 10 which drives an axially aligned female rotor 12 is shown. Male rotor 10 is driven by a motor, not shown, as is well known. Male rotor 10 has four lobes 14–17 with a 300° wrap and female rotor 12 has six flutes 18–23 with a 200° wrap. Accordingly, the compression-discharge phase of the axial sweep with respect to male rotor 10 occupies about 300° of rotation. The resulting gap between the male and female rotors requires oil to be introduced into the compression area for sealing, however, the oil also provides cooling and lubricating, as is well known. However, the introduction of this oil requires the use of an oil separation device, to separate the oil from the refrigerant being compressed in HVAC compressors. The primary benefit of the twin rotor configuration is the low interface velocity between the male and female rotors during operation. However, the twin rotor configuration is not balanced and therefore incurs large radial bearing loads and thrust loads. The obvious solution to alleviating the bearing load problem would be to install sufficiently sized bearings. This is not a feasible solution, since the relative diameters of the rotors in practice result in the rotors being too close together to allow installation of sufficiently sized bearings.

The prior art has addressed this problem, with the introduction of compressors employing 'so-called' single screw technology. Referring to FIGS. 2 and 3 herein, labeled prior art, a drive rotor 24 with two opposing axially perpendicular gate rotors 26 and 28 is shown. Rotor 24 is driven by a motor, not shown, as is well known. Rotor 24 has six grooves 30 and each gate rotor 26, 28 has eleven teeth 32, 34, respectively, which intermesh with grooves 30. The gate rotors 26 and 28 are generally comprised of a composite material which allows positioning of the gate rotor at a small clearance from the drive rotor. This clearance is small enough that the liquid refrigerant itself provides sufficient sealing, the liquid refrigerant also provides cooling and lubrication. The rearward positioning of gate rotors 26 and 28 and the positioning on opposing sides of drive rotor 24, (1) allows equalizing suction of pressure at both ends of rotor 24 thereby virtually eliminating the thrust loads encountered with the above described twin screw system and (2) balances the radial loading on rotor 24 thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

SUMMARY OF THE INVENTION

The above-discussed and other drawbacks and deficiencies of the prior art are overcome or alleviated by the multi-rotor compressor of the present invention. In accordance with the present invention, the compressor includes a male rotor which is axially aligned with and in communication with at least two female rotors. The male rotor is driven by a motor, in other words the male rotor is the drive rotor. The male rotor has a plurality of lobes which intermesh with a plurality of flutes on each of the female rotors. The pitch diameters of the female rotors are now less than the pitch diameter of the male rotor.

The male rotor comprises an inner cylindrical metal shaft with an outer composite material ring mounted thereon. The ring includes the lobes of the male rotor integrally depending therefrom. The lobes of the male rotor being comprised of a composite material allows positioning of the female rotors at a small clearance from the male drive rotor. This clearance is small enough that the liquid refrigerant itself provides sufficient sealing, however, the liquid refrigerant also provides cooling and lubrication.

The positioning of the female rotors on opposing sides of the male rotor balances the radial loading on the male rotor thereby minimizing radial bearing loads. Further, due to a larger diameter male drive rotor as compared to the male drive rotor in the prior art twin screw compressors, and therefore, additional distance between the rotors, any female radial bearing loads can be easily accommodated with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

| Figure | No. Male Rotors/Lobes | No. of Female Rotors/Flutes |
|---|---|---|
| 13A | 1/8 | 2/5 |
| 13B | 1/8 | 2/6 |
| 13C | 1/8 | 2/7 |
| 13D | 1/9 | 2/5 |
| 13E | 1/10 | 2/5 |
| 13F | 1/10 | 2/6 |
| 13G | 1/10 | 2/7 |
| 13H | 1/12 | 2/7 |
| 13I | 1/11 | 3/5 |
| 13J | 1/12 | 3/5 |
| 13K | 1/12 | 3/6 |
| 13L | 1/12 | 3/7 |
| 13M | 1/15 | 3/5 |
| 13N | 1/15 | 3/7 |
| 13O | 1/16 | 4/6 |
| 13P | 1/20 | 4/7 |

DESCRIPTION OF THE PREFERRED EMBODIMENT

Figure 4:
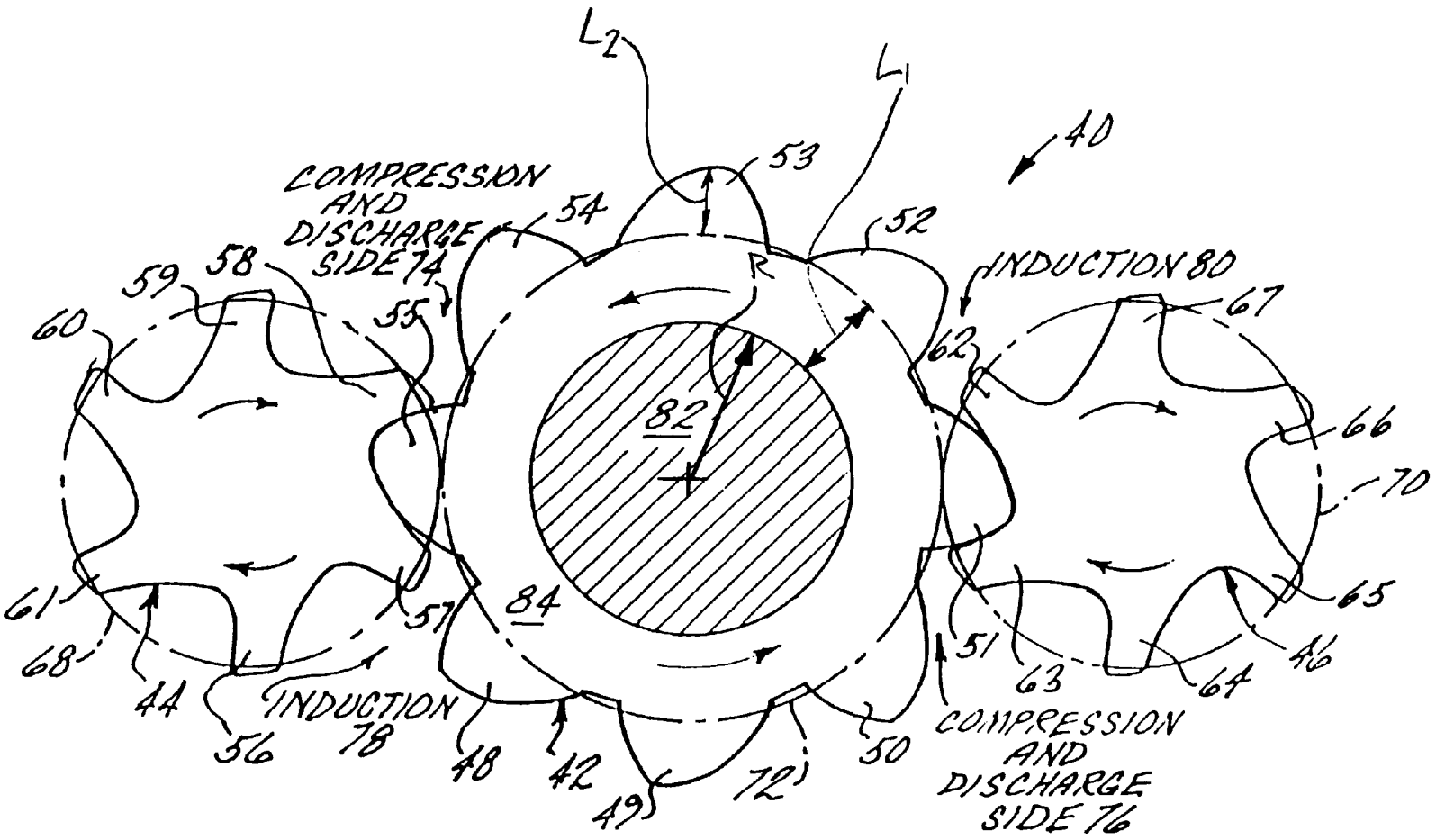
FIG. 4 is a diagrammatic cross sectional view of a tri-rotor configuration in accordance with the present invention.

Referring now to FIG. 4, a cross sectional view of a rotor configuration for use in compressors in accordance with the present invention is generally show at 40. A male rotor 42 is axially aligned with and in communication with female rotors 44 and 46. Male rotor 42 is driven by a motor, described hereinafter, and the male rotor drives the female rotors. The multi-rotor compressor of the present invention includes a plurality of commercially viable combinations between the number of female rotors 44, 46, the number of flutes 56–61 on the female rotors, and the number of lobes 48–50 on the male rotor as will be described in more detail herein below. In this example, male rotor 42 has eight lobes 48–55 with a 150° wrap, female rotor 44 has six flutes 56–61 with a 200° wrap, and female rotor 46 has six flutes 62–67 with a 200° wrap. The pitch diameters 68, 70 of the female rotors 44, 46 are less than the pitch diameter 72 of the male rotor 42. Accordingly, the compression/discharge phase of the axial sweep with respect to male rotor 42 occupies about 150° of rotation. Duplicate processes are occurring simultaneously on the top and bottom of the male rotor.

Male rotor 42 comprises an inner cylindrical metal shaft 82 with an outer composite material ring 84 mounted thereon. Shaft 82 is preferably comprised of steel, ductile iron or other material of comparable strength for supporting the rotor. Ring 84 includes lobes 48–55 integrally depending therefrom. Ring 84 is preferably comprised of a thermoplastic or other suitable composite material for use in compressors, i.e., suitable for high pressure application. The larger diameter male drive rotor as compared to the male drive rotor in the prior art twin screw compressors allows for the above described two piece construction. The smaller diameter male drive rotor in the prior art twin screw compressors could not be constructed as described above since a small diameter inner shaft would not be strong enough to properly support the rotor. The male drive rotor in the prior art moderate high pressure twin screw compressors is comprised of solid unitary metal piece. It will be appreciated that certain operating parameters of male rotor 42 such as inertial resistance, stiffness, vibration resistance and critical frequency are controlled by the relationship between the sizes of metal shaft 82 and composite ring 84. The thickness of composite ring 84 is the distance between metal shaft 84 and pitch diameter 72 represented by the arrow labeled L1 and the distance between the pitch diameter and the tip of each lobe 48–55 represented by the arrow labeled L2. The thickness of a typical composite ring 84 ranges from one where L1 is at least half of L2 to one where L1 is the same distance as L2. A preferred male rotor 42 is comprised of a metal shaft having a radius represented by the arrow labeled R where R ranges from 1.67(L1+L2) in an embodiment with the thinnest preferable composite ring 42 to one where R is equal to L1+L2.

The significance of the lobes 48–55 being comprised of a composite material, is that it allows positioning of the female rotors 44 and 46 at a small clearance from the male drive rotor 42. This clearance is small enough that droplets of the liquid refrigerant itself entrained in the gaseous phase of the refrigerant to be compressed provide sufficient sealing, cooling, and lubrication of the rotors. My copending U.S. patent application Ser. No.: 09/245,516, filed Feb. 5, 1998, and which is incorporated herein by reference, disclosed an example of apparatus and method for controlling the amount of liquid droplets entrained in the gaseous refrigerant. Accordingly, the need to introduce oil into the compression area, such as in the prior art twin screw compressors for sealing, cooling and lubricating is eliminated because the composite material can be adequately lubricated with liquid refrigerant. Further, the positioning of female rotors 44 and 46 on opposing sides of male rotor 42 balances the radial loading on male rotor 42 thereby minimizing radial bearing loads. Also, due to larger diameter male drive rotor as compared to the male drive rotor in the prior art twin screw compressors and therefore the additional distance between the rotors, any female radial bearing loads can be easily accommodated with sufficiently sized bearings. It will also be appreciated, that interface velocity between the male and female rotors during operation is very low, whereby the extensive damage suffered by the prior art single screw compressors when lubrication is lost, due to the high interface velocities of the rotors, is reduced. The low interface velocity results in minimal sliding action at the pitch band interface of the rotors.

Figure 5A:
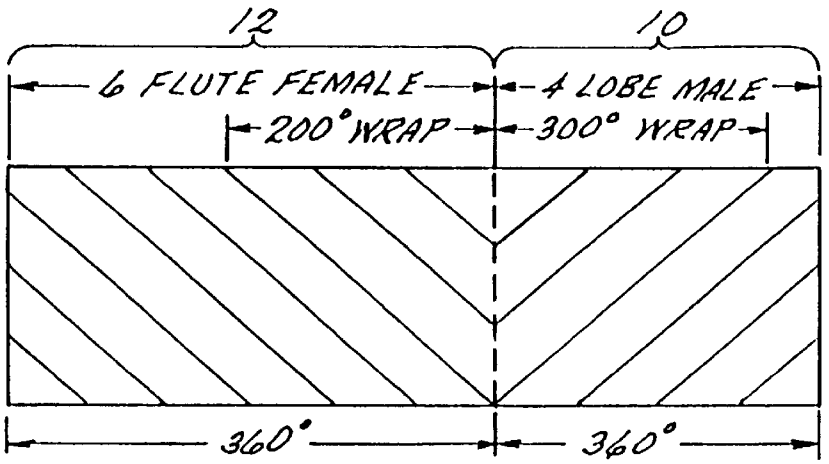
FIG. 5A (PRIOR ART)
FIG. 5A is a diagrammatic unwrapped pitch line study of the prior art twin screw or rotor configuration of FIG. 1.
Figure 5B:
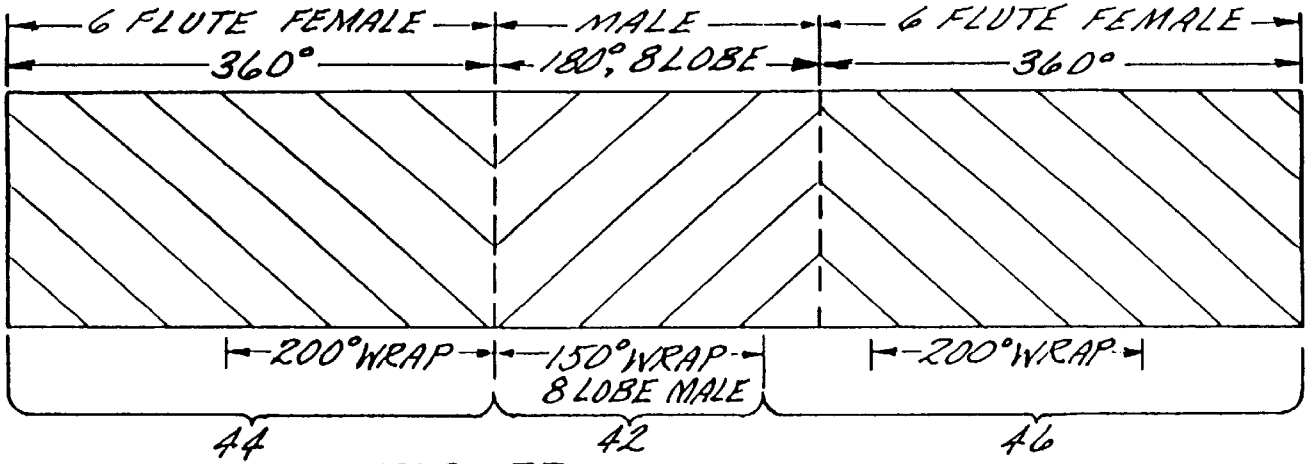
FIGURE 5B is a diagrammatic unwrapped pitch line study of the tri-rotor configuration of FIG. 4.

Referring to FIGS. 5A and B diagrammatic unwrapped pitch line studies are provided. FIG. 5A is an unwrapped pitch line study of the prior art twin rotor of FIG. 1. FIG. 5B is an unwrapped pitch line study of the rotor configuration 40 of FIG. 4.

Figure 6:
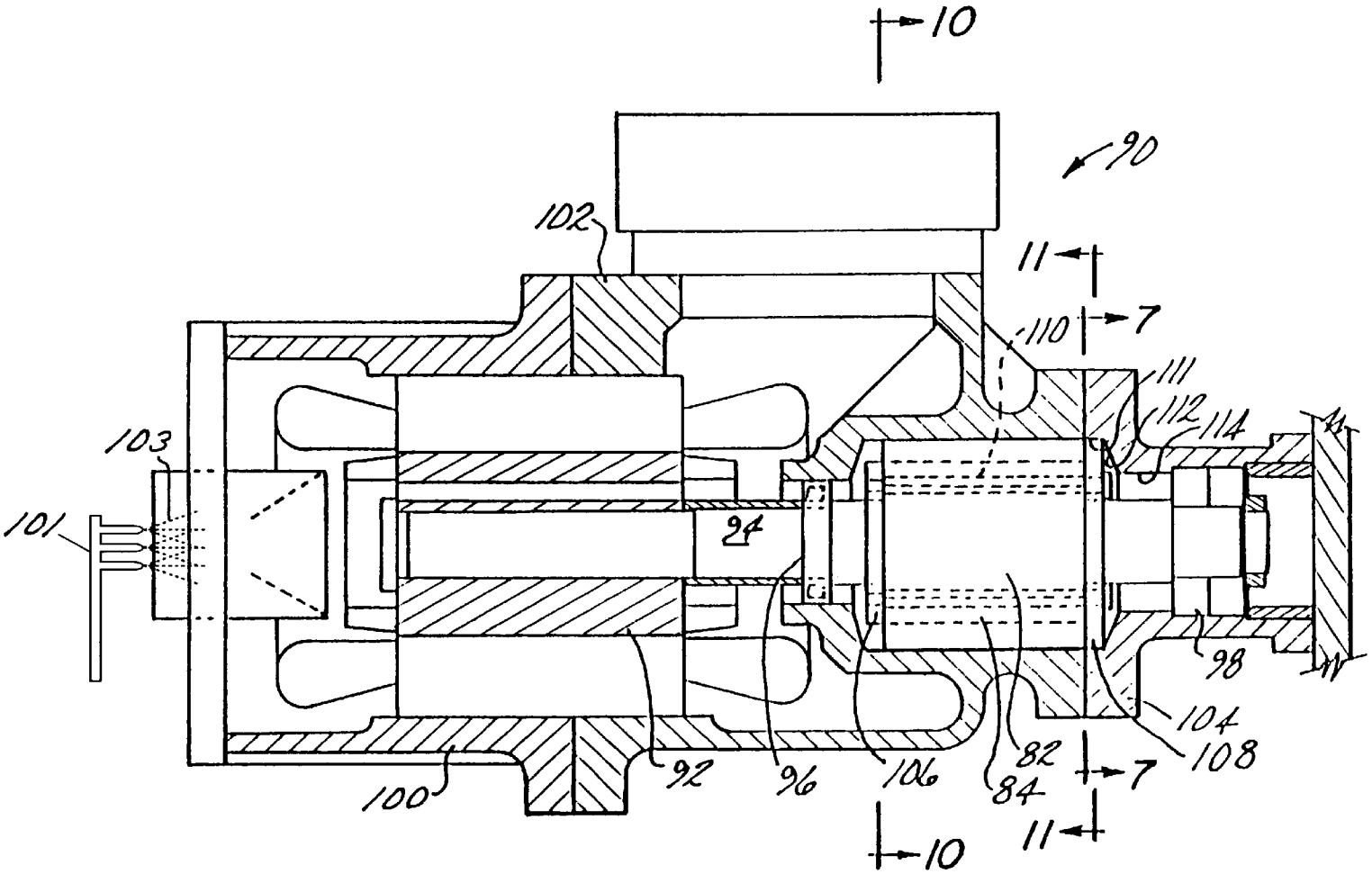
FIG. 6 is a diagrammatic side cross sectional view of a compressor employing the multi-rotor configuration of FIG. 4.
Figure 7:
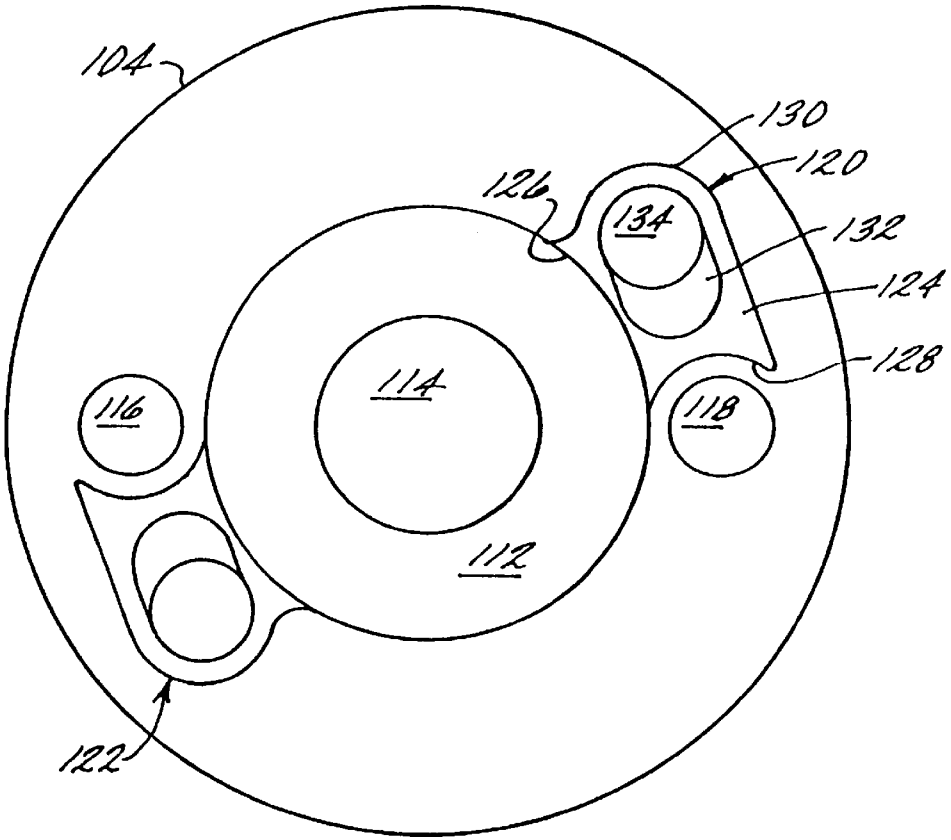
FIG. 7 is a view taken along the line 7—7 of FIG. 6 with the discharge plate removed for clarity.

Referring to FIGS. 6 and 7, a compressor employing the rotor configuration 40 of the present invention is shown generally at 90. Compressor 90 includes a hermetically sealed motor 92 having a drive shaft 94 which is integral with shaft 82 of male rotor 42 for driving the same. As described above, a bearing 96 is mounted at shaft 82 in between motor 92 and rotor 42 and a bearing 98 is mounted at one end of the shaft 82 to absorb any remaining radial bearing loads. Bearing 96 is shown as a cylindrical roller bearing. Bearing 98 is shown as a double row angular contact ball type.

Compressor 90 further comprises a housing having an inlet or induction housing portion 100 for induction into the compressor of the gaseous refrigerant with the entrained droplets of liquid refrigerant (from the evaporator of a cooling or refrigeration system), a main housing portion 102 and a discharge housing portion 104. Alternatively, liquid droplets 103 of refrigerant could be introduced by atomization of the liquid droplets into the gaseous refrigerant at or near the inlet end of the compressor, such as by spray nozzles 101 located at or near the inlet to the compressor, as shown in FIG. 6.

Figure 10:
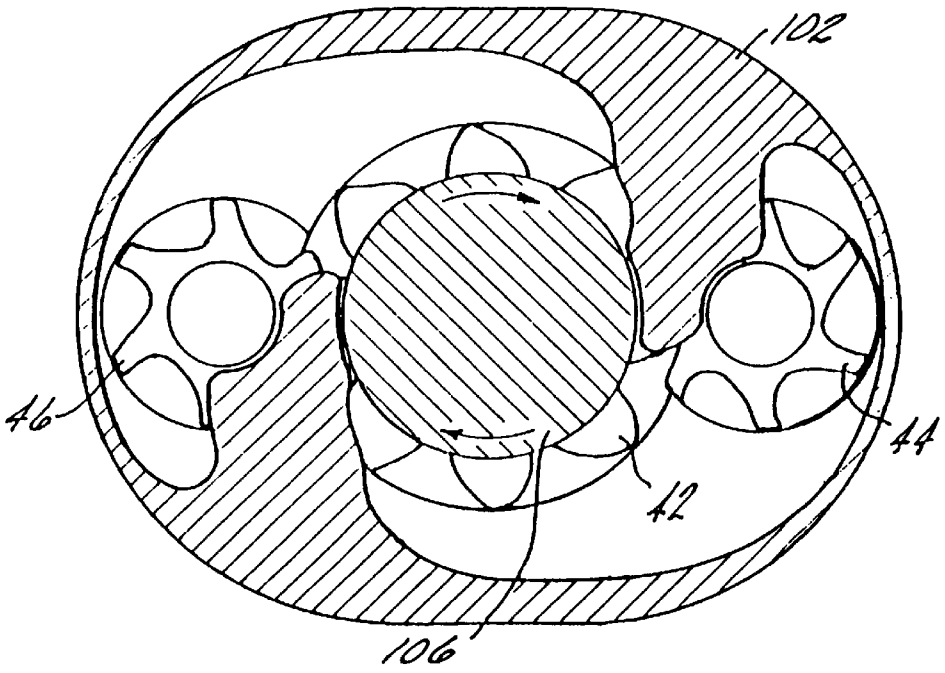
FIG. 10 is a view taken along the line 10—10 of FIG. 6.
Figure 9:
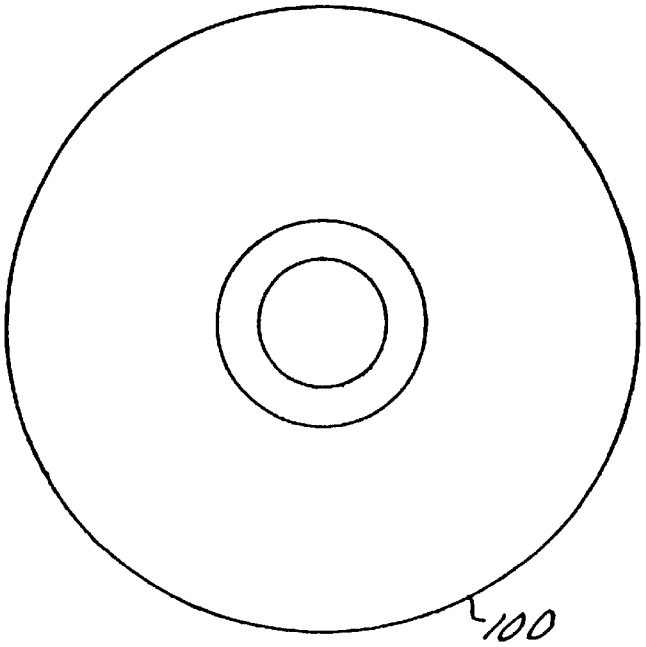
FIG. 9 is an induction end view of the compressor of FIG. 6.

An induction side plate 106 and a discharge side plate 108 are mounted on male rotor 42 by a plurality of dowels 110 and bolts. Induction at housing portion 100 is shown in FIG. 9 and the induction side plate 106 is shown in FIG. 10. The center line of the dowels lies at the intersection of ring 84 and shaft 82, whereby cooperating semi-circular, longitudinal grooves 11, 10 are formed at the outer surface of shaft 82 and the inner surface of ring 84 for receiving the dowels. The outside diameter of plate 106 is equal to the root diameter of the male rotor 42. The outside diameter of plate 108 is equal to the crest diameter of the male rotor 42. Plates 106 and 108 serve two purposes: to secure ring 84 on shaft 82 and to equalize suction pressure at both ends of the male rotor 42 thereby virtually eliminating the thrust loads encountered with the prior art twin screw compressors.

Discharge porting is defined in housing 104 wherein trap pocket relief is provided. The problem of a trapped pocket is well known in the art of compressors. More specifically, the trap pocket is generated as a lobe reduces the area between the two flutes, a small void between the lobe and one of the flutes traps a pocket of compressed refrigerant. This trapped pocket of refrigerant must be relieved, otherwise the resistance generated by the trapped pocket may damage the compressor.

Figure 12:
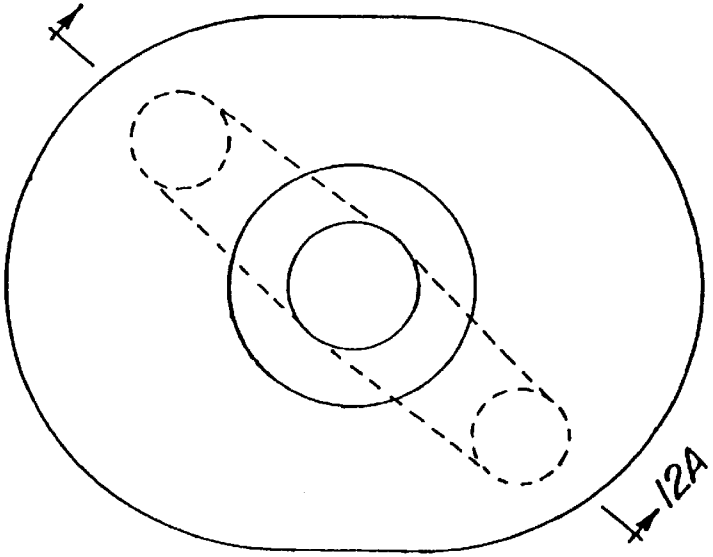
FIG. 12 is a discharge end view of the compressor of FIG. 6.
Figure 12A:
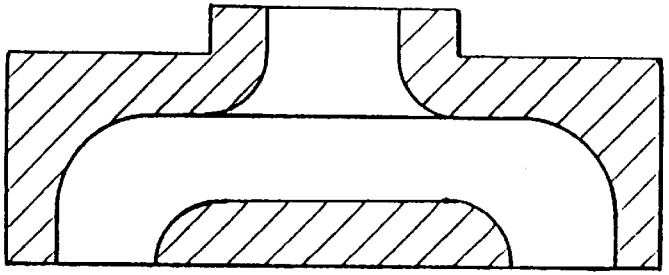
FIG. 12A is a view taken along the line 12A—12A of FIG. 12.
Figure 11:
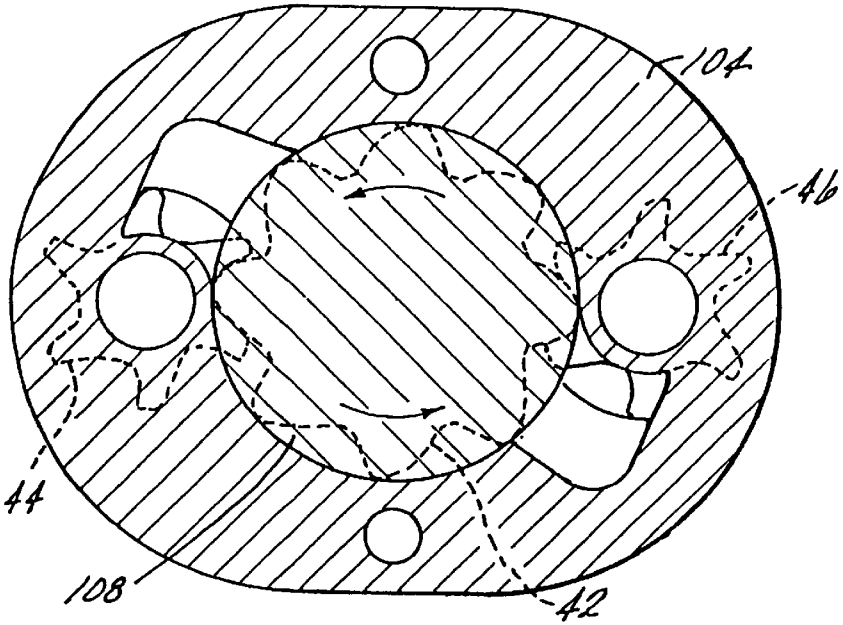
FIG. 11 is a view taken along the line 11—11 of FIG. 6.
Figure 13A:
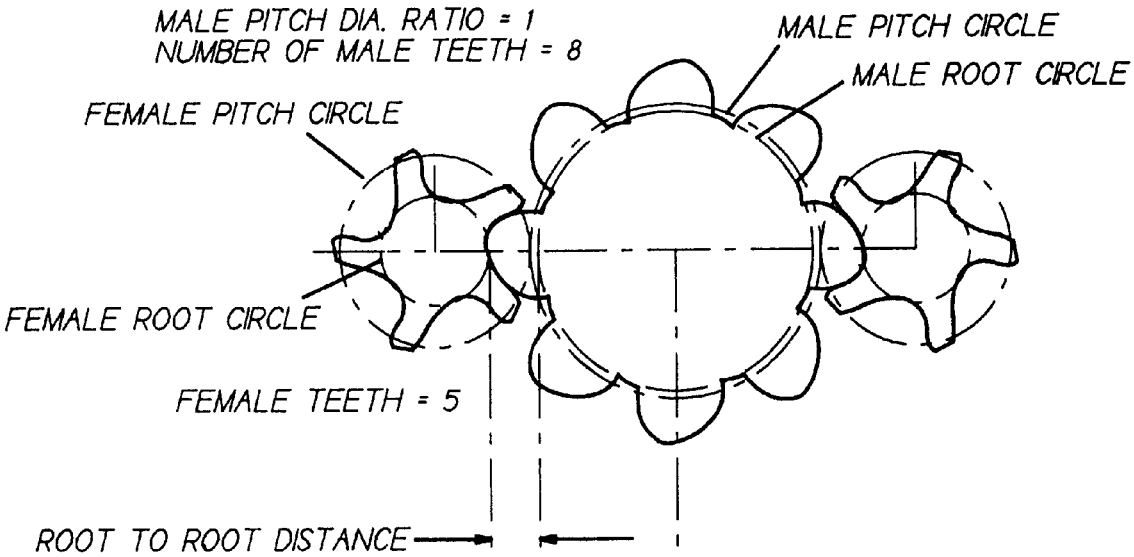
FIGS. 13A–13P are views similar to FIG. 4 showing the following configurations of male rotors/lobes and female rotors/flutes combinations.
Figure 13B:
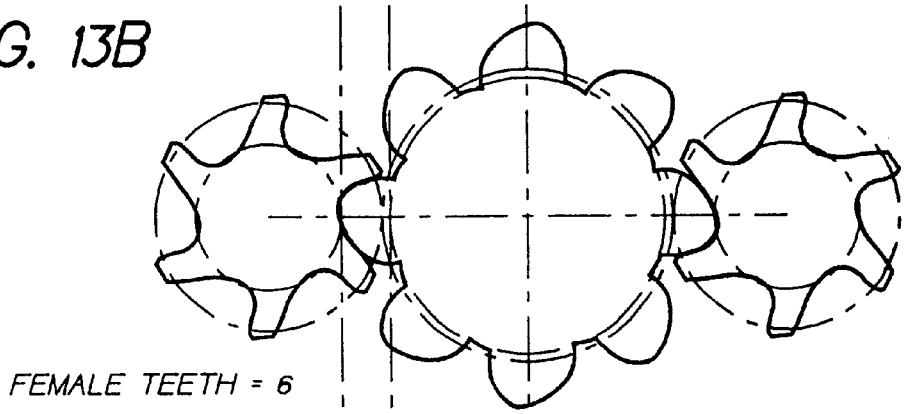
Figure 13C:
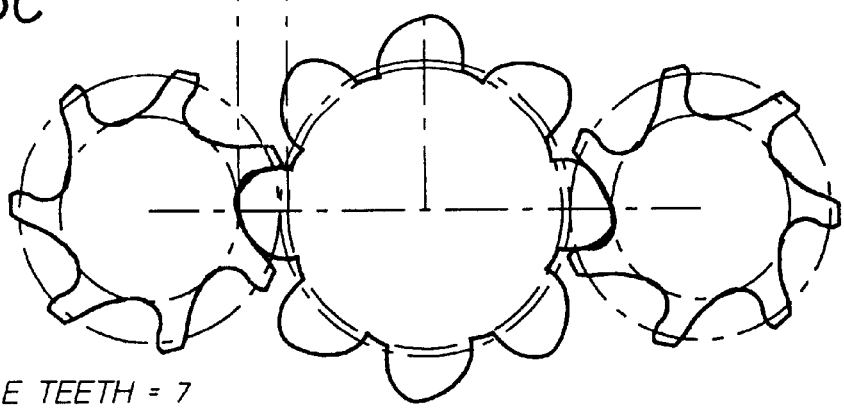
Figure 13D:
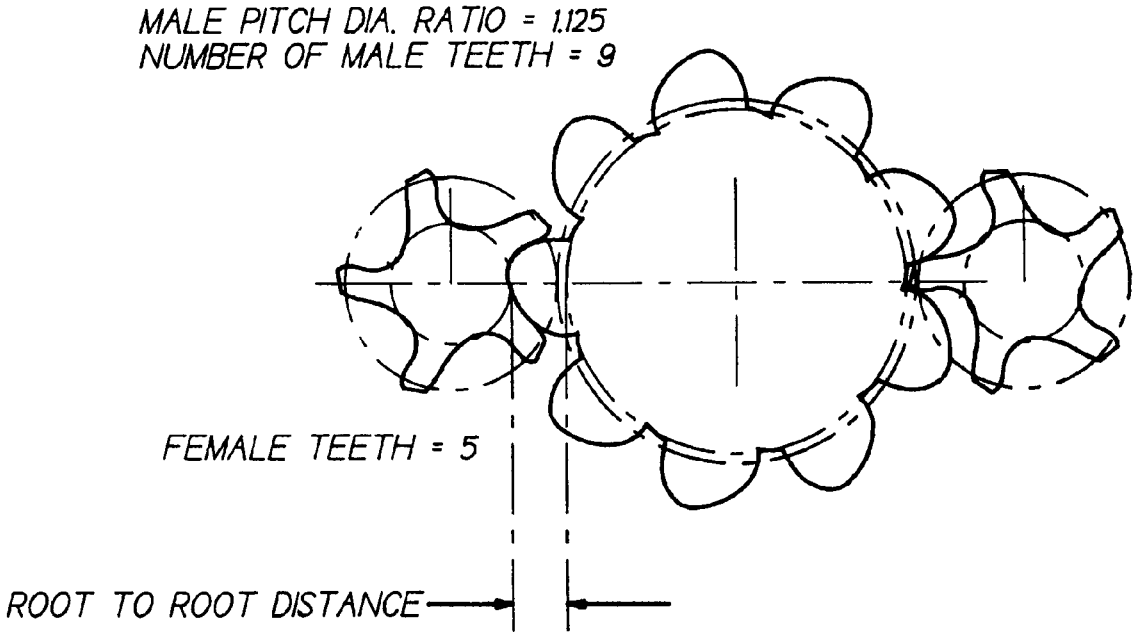
Figures 13E, 13F, 13G:
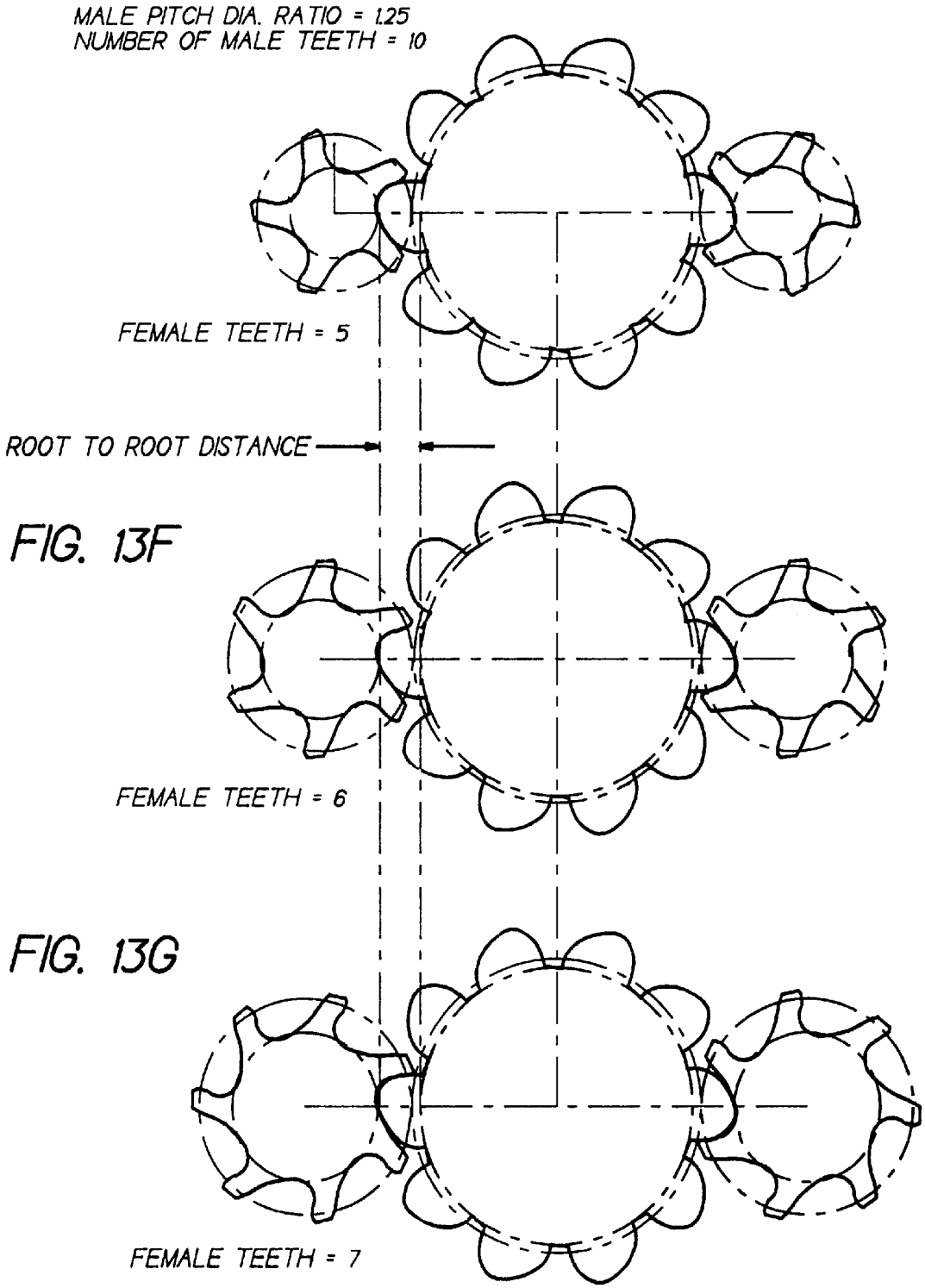
Figure 13H:
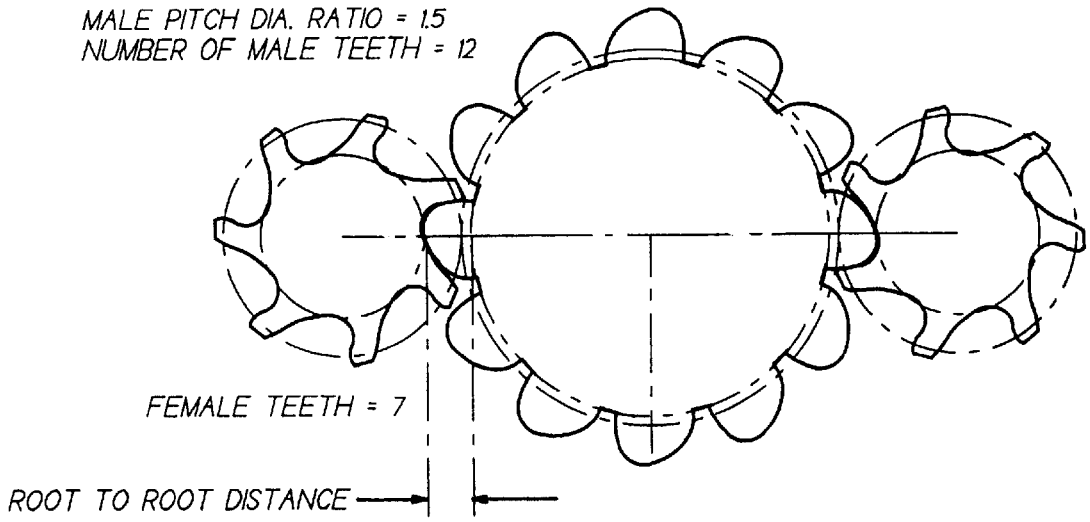
Figure 13I:
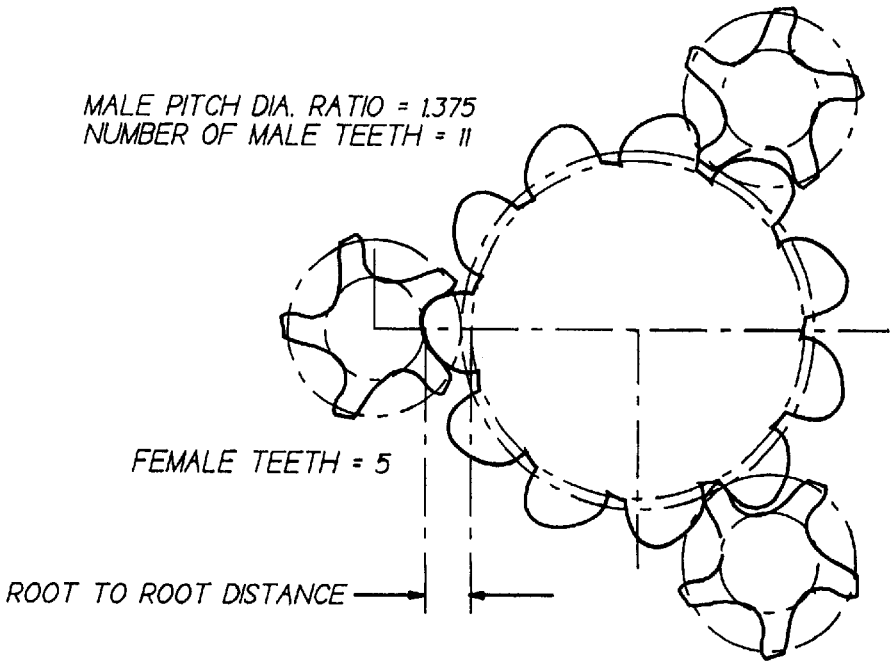
Figures 13J, 13K:
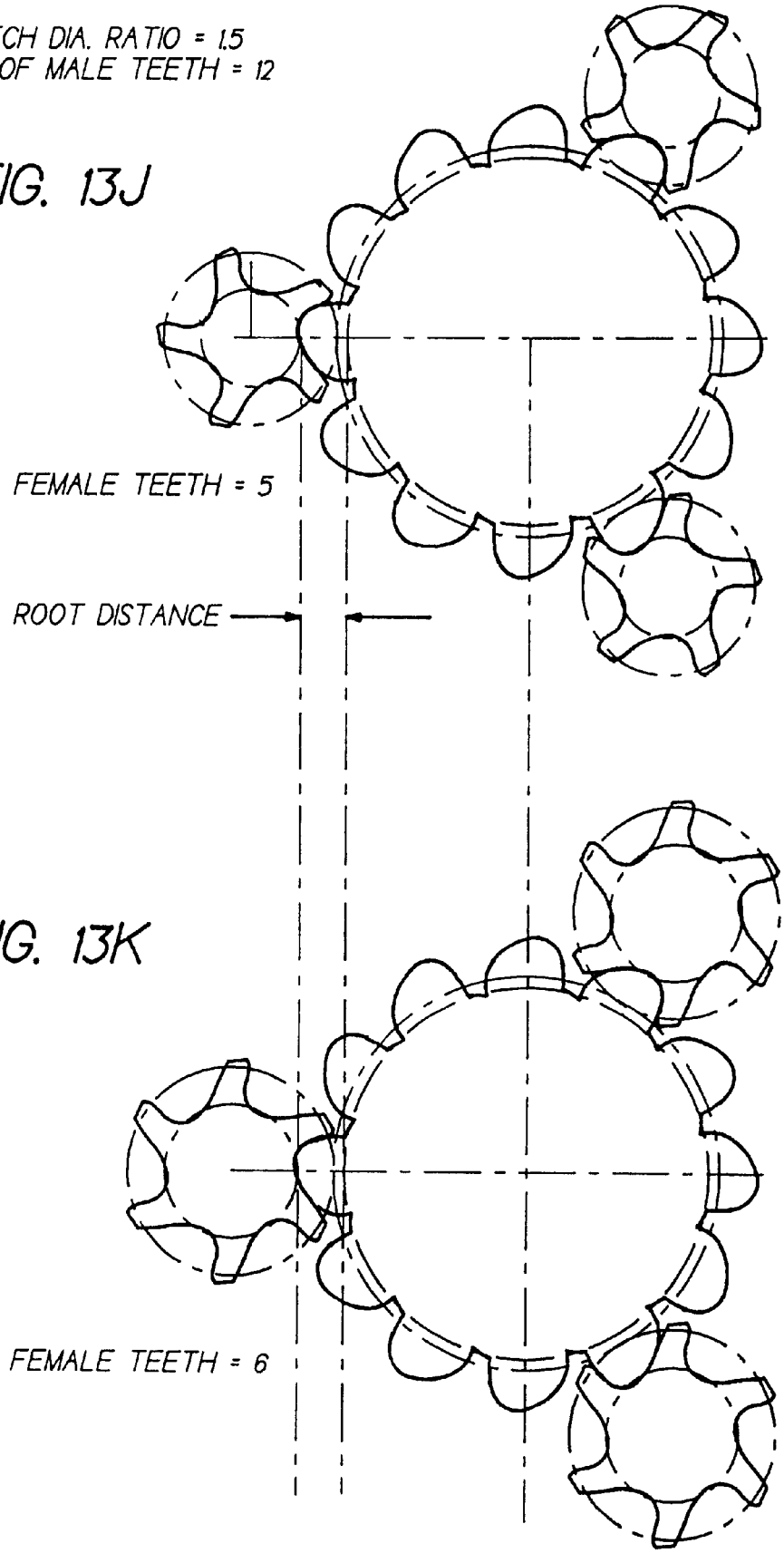
Figure 13L:
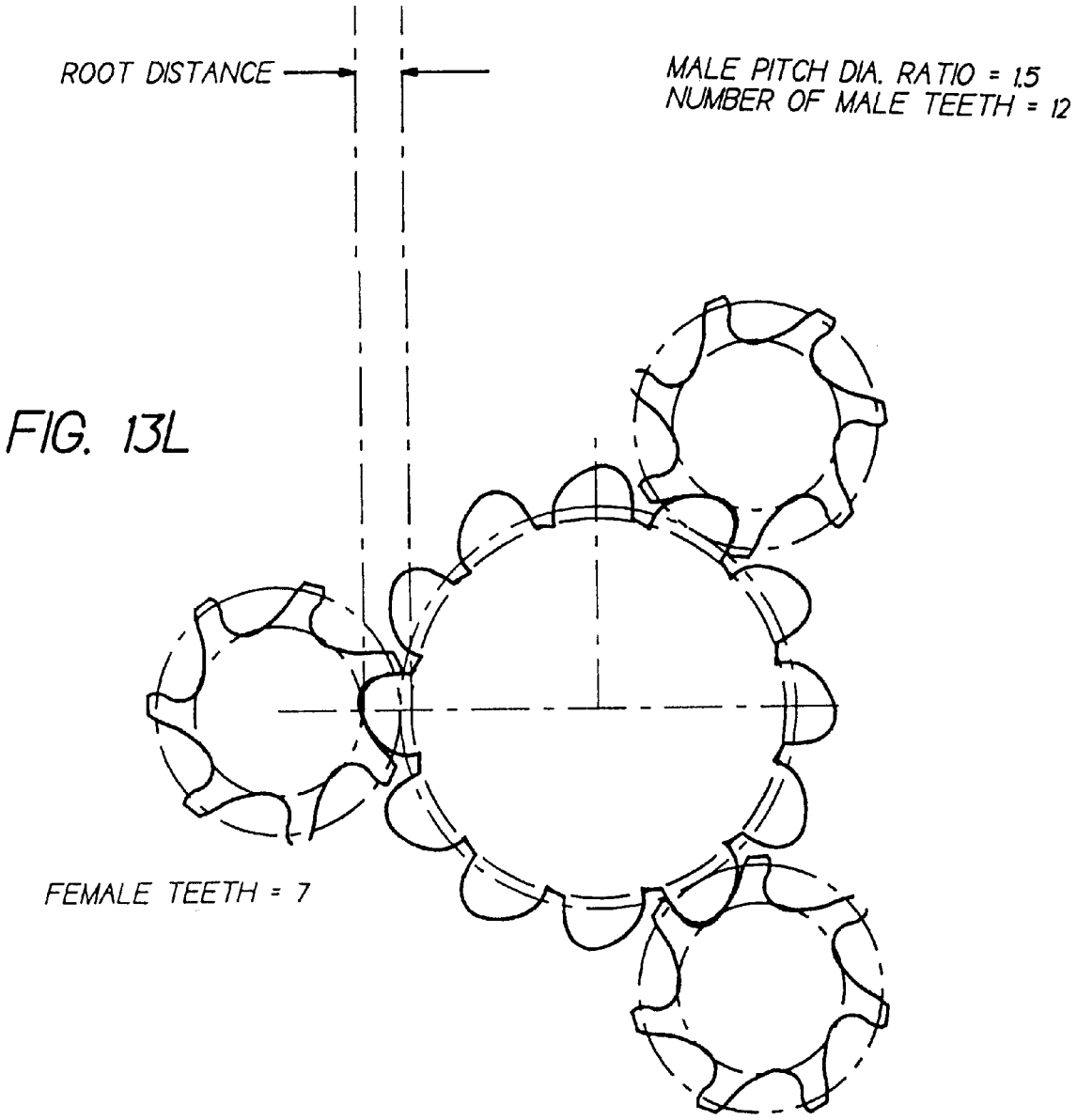
Figure 13M:
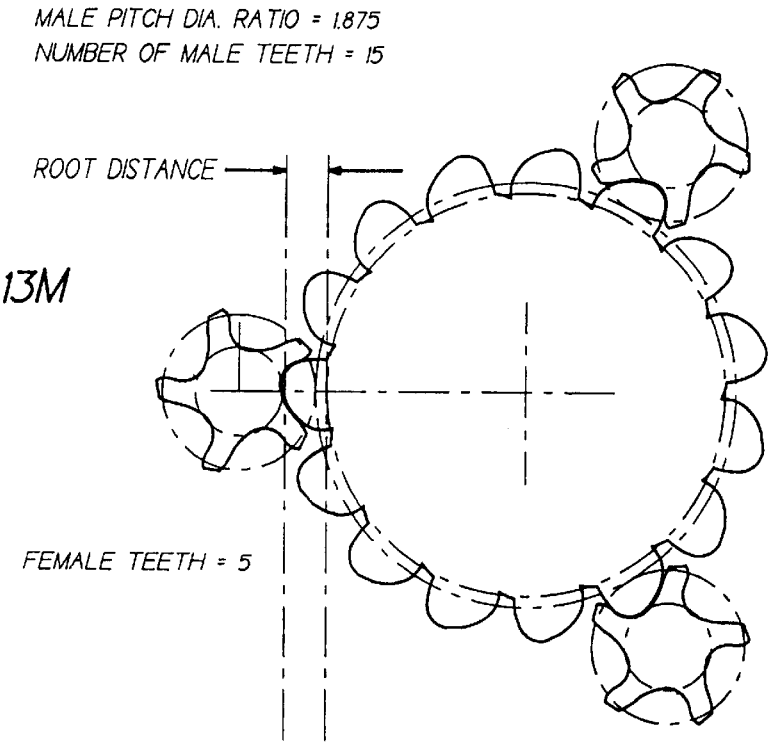
Figure 13N:
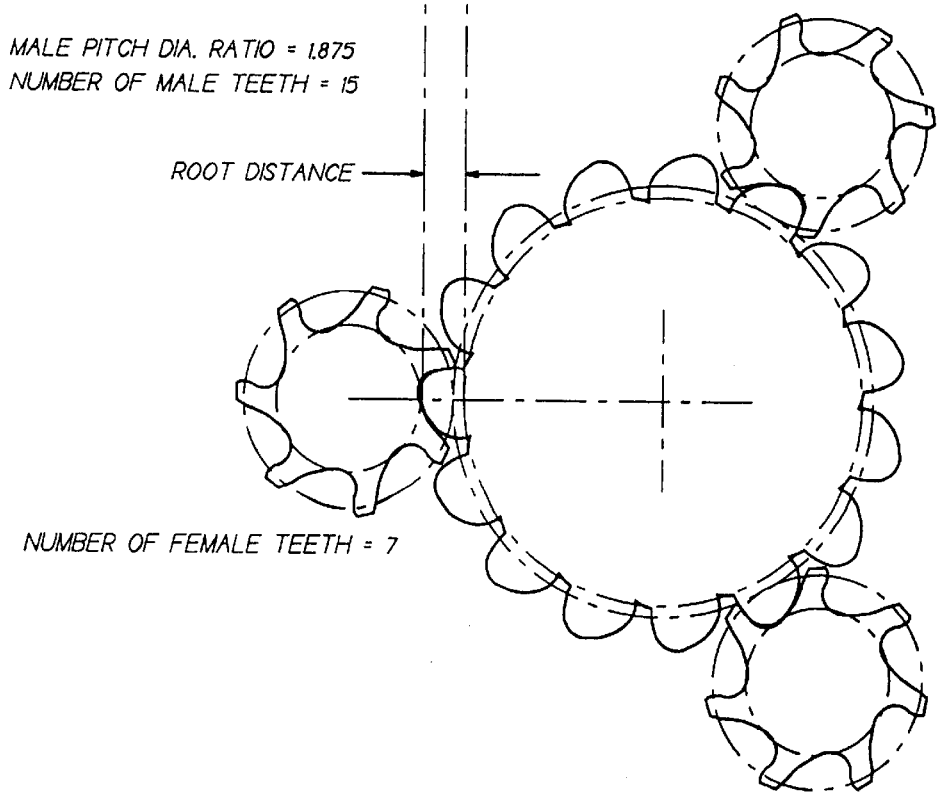
Figure 130:
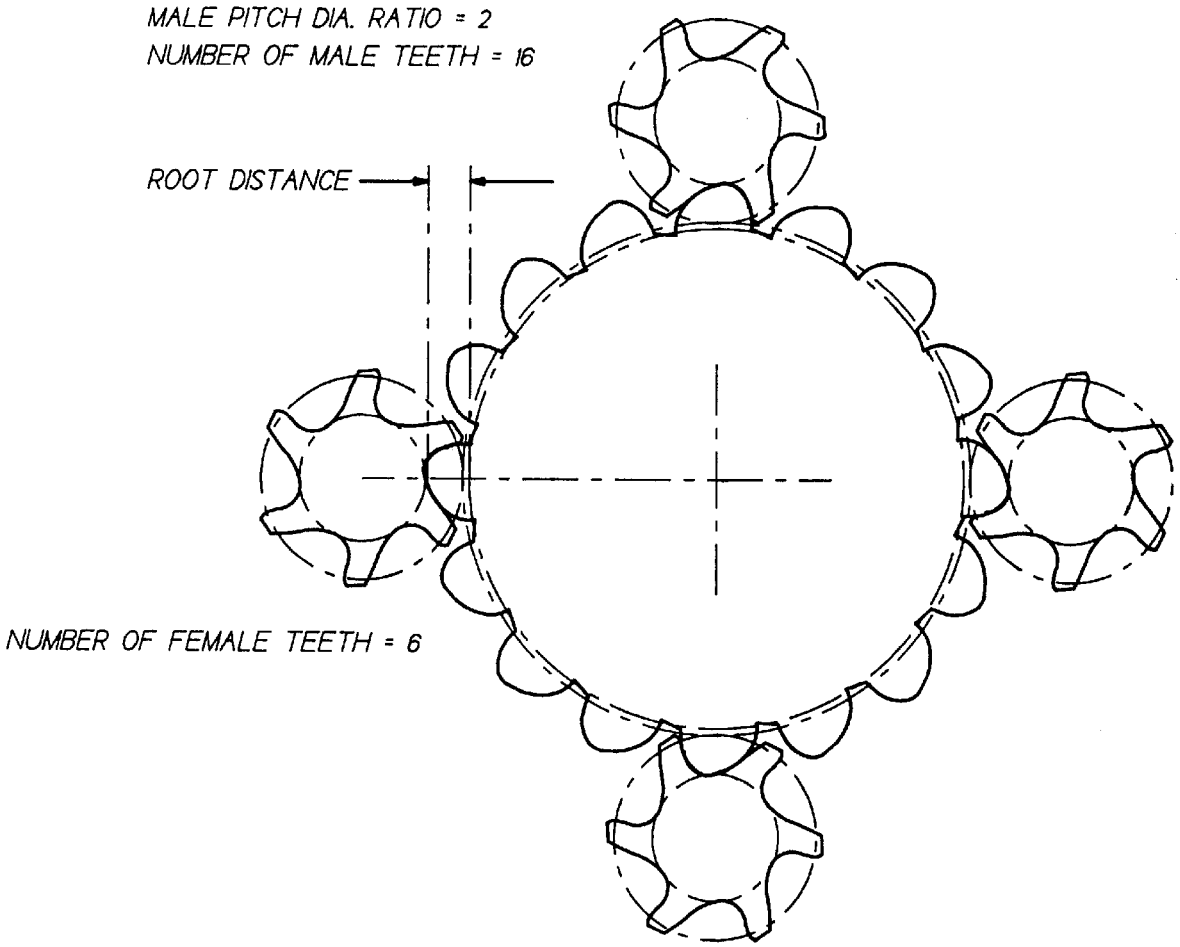
Figure 13P:
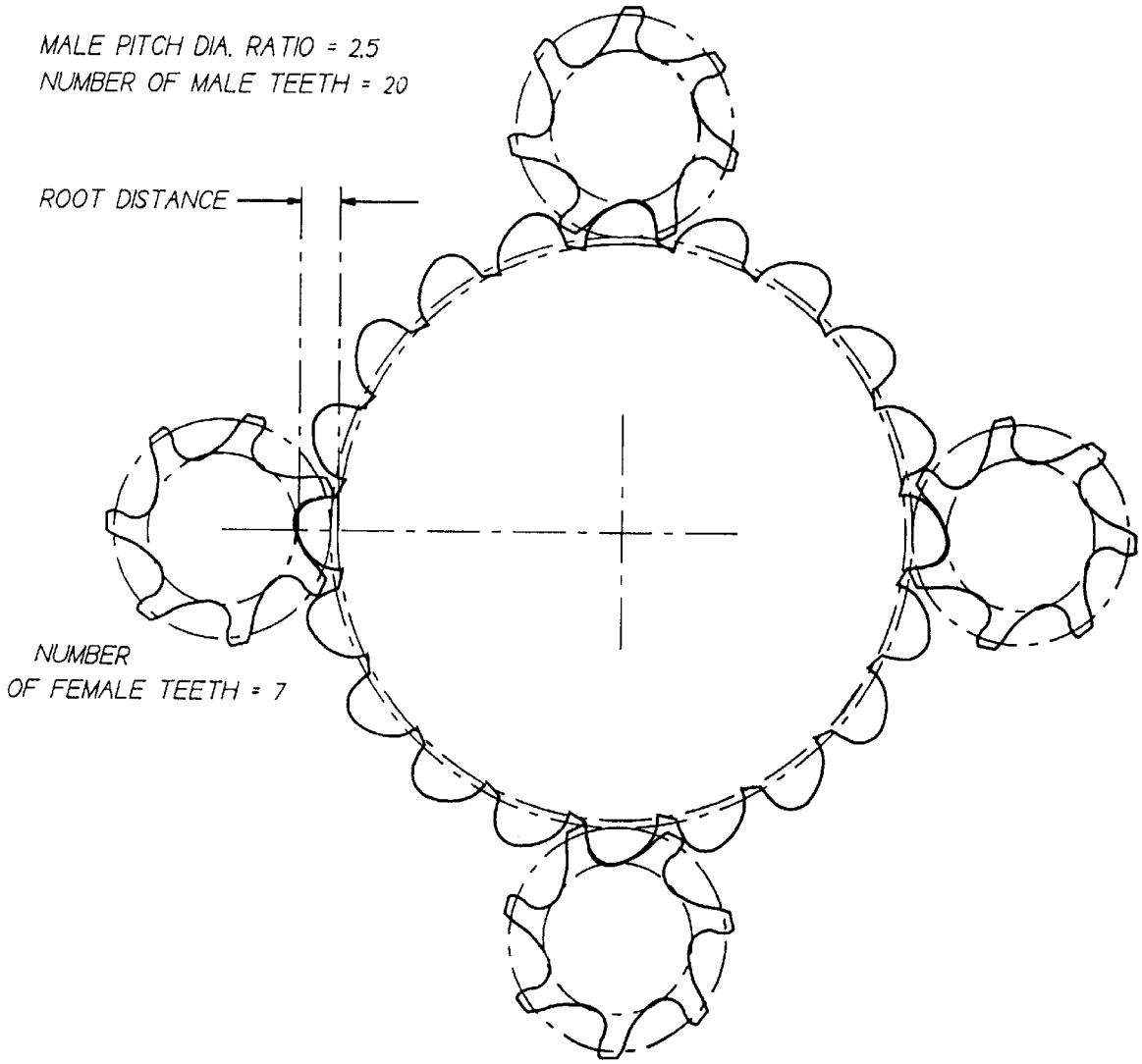

Housing 104 includes an inner circumferential surface 111 for receiving plate 108. A clearance is defined between the outer circumference of plate 108 and the inner circumferential surface 111 of housing 104. An inwardly countersunk surface 112 depends from surface 111, which allows the clearance between plate 108 and surface 111 to be sealed by the liquid refrigerant, thereby minimizing leakage back to the low side of the compressor. Moreover, the discharge side of the male rotor 82 being sealed off from the high side by plate 108 causes the pressure on both ends of male rotor 82 to be equalized. Further, as is readily apparent to one of ordinary skill in the art, the high pressure at the interface of the discharge side of the male rotor 82 and the plate 108 acts on plate 108 in the direction to the right in FIG. 6 and acts on the lobes of the male rotor 82 in an equal and opposite direction (i.e., to the left in FIG. 6). These equal and opposite forces result in the elimination of the thrust loads on the male rotor. Countersunk surface 1 12 terminates at an opening or hole 114 with the shaft of the male rotor 82 disposed therein. Openings or holes 116 and 118 are also provided for receiving the shafts of the female rotors 44 and 46, respectively, as best shown in FIG. 7. Compression and discharge side 74 (i.e., the corresponding radial discharge area of male rotor 42 and the axial discharge port area of female rotor 44) communicates with discharge porting 120 and compression and discharge side 76 (i.e., the corresponding radial discharge area of male rotor 42 and the axial discharge port area of female rotor 46) communicates with discharge porting 122. Discharge at discharge plate 108 is shown in FIG. 11 and at housing portion 104 is shown in FIGS. 12 and 12A. Since discharge porting 120 operates the same as discharge porting 122, only discharge porting 120 is described in detail below.

Discharge porting 120 comprises a first stepped down portion 124 defined by a line 126 which represents the circumferential distance encompassed when surface 124 intersects inner circumferential surface 111, an edge 128 which follows the root diameter of female rotor 44 and a curved edge 130 which communicates with the periphery of the remaining radial and axial port areas, such areas being well known and defined in the art. This first stepped down portion 124 provides relief on the female rotor side of the aforementioned trapped pocket, since such will be aligned with this portion. A second further stepped down portion 132 depends from stepped down portion 124 and generally aligns with the axial port area of female rotor 44. Both portions 124 and 132 lead into a discharge opening 134 which generally aligns with the radial flow area. The discharge opening from discharge porting 120 and 122 are combined and form a single discharge output for the compressor. The operation of the compressor will now be more fully described. FIG. 4 shows the directions of rotation, the typical profiles of the rotors, and their typical pitch circles. It also shows compression and discharge side 74 occurring between the center male rotor 42 and left female rotor 44 and an identical and simultaneous process occurring on the bottom between the center male rotor 42 and the cooperating right female rotor 46 at compression and discharge side 76. Note, too, induction ports 78 and 80 shown in FIG. 4.

Figure 1:
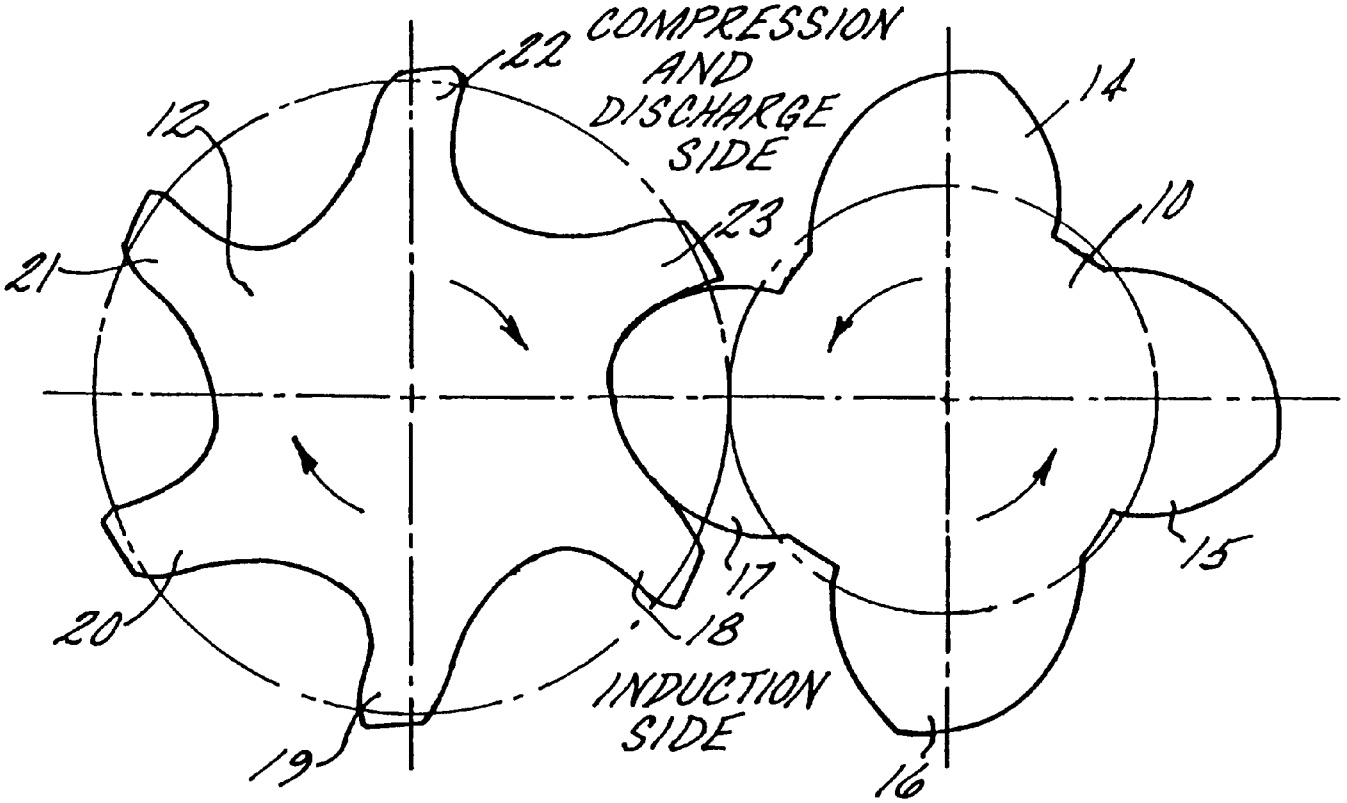
FIG. 1 (PRIOR ART)
FIG. 1 is a diagrammatic cross sectional view of a twin screw or rotor configuration in accordance with the prior art.
Figure 2:
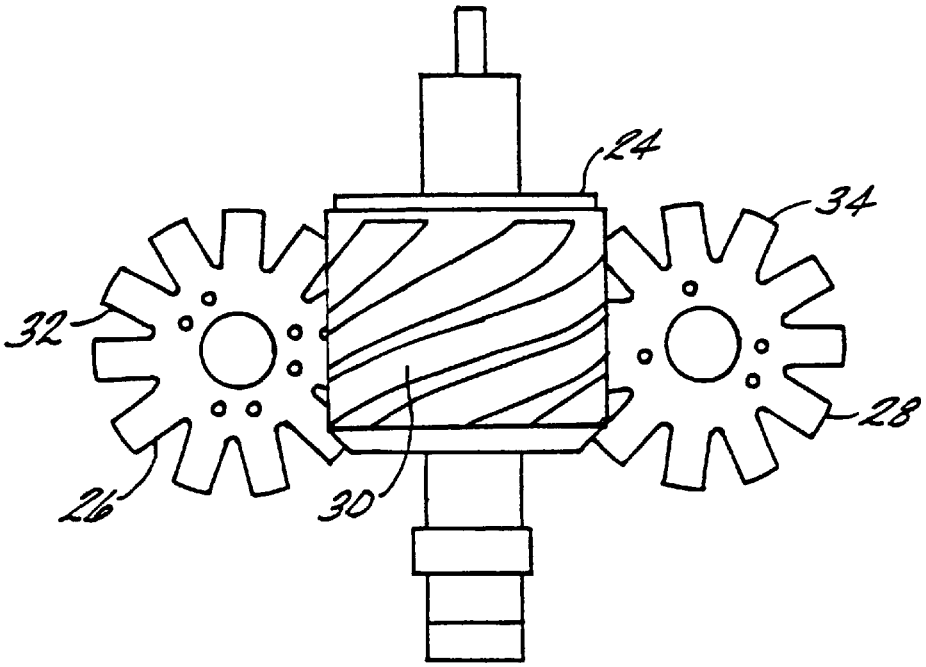
FIG. 2 (PRIOR ART)
FIG. 2 is a diagrammatic top view of a single screw configuration in accordance with the prior art.
Figure 3:
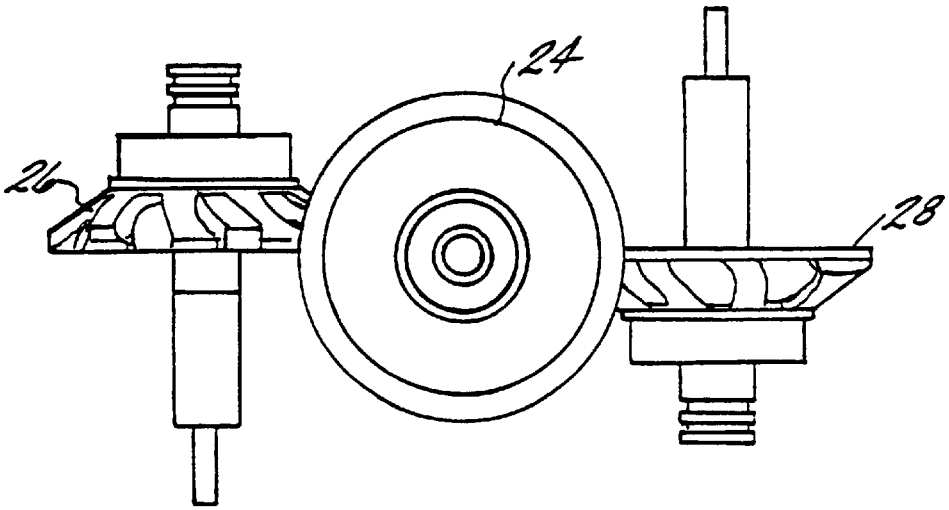
FIG. 3 (PRIOR ART)
FIG. 3 is a diagrammatic end view of the single screw configuration of FIG. 2.

Each female rotor 44 and 46 cooperates with male rotor 42 in a manner well known to those familiar with the traditional twin screw rotary compressor, represented in FIGS. 1 and 5A. Referring again to FIG. 4, at each induction port 78, 80, the lobes 48–55 and flutes 56–67 separate and are radially exposed to the inlet as seen in FIG. 10, which, compared with FIG. 4, is an opposite view of rotors 42, 44, 46 from the inlet side of the compressor. FIG. 5B schematically shows the cooperating pitch lines of the rotors (unwrapped so as to allow a two dimensional representation) as they would be seen when looking up at the bottom of FIG. 4. Therefore, since the left and right female rotors 44, 46 are rotating clockwise in FIG. 4, the pitch lines in FIG. 5B of the left and right rotors 44, 46 will appear to move to the left, while the pitch lines of male rotor 42 will appear to move to the right, and so the pitch lines of male rotor 42 and female rotor 46 come together along the interface between them as seen in FIG. 5B. At the same time, the pitch lines of female rotor 44 and male rotor 42 are separating along the interface between them as seen in FIG. 5B.

Each space between the pitch lines in FIG. 5B represents a chamber, as would be readily apparent to a person of ordinary skill in the art. In the male rotor 42, the chambers are formed between adjacent lobes; in the female rotors 44 and 46, the chambers are formed within each flute. Looking at the center male rotor 42, the chambers closest to the upper left corner are in communication with the low pressure side of the compressor. As male rotor 42 rotates to the right, the chamber reaches a point that extends from the lower left to the upper right comer of the profile of male rotor 42 shown in FIG. 5B. At this position, it is closed off from the inlet and outlet sides of the compressor by an end plate as seen in FIG.

10. As male rotor 42 continues to rotate to the right, the chamber interfaces with chambers carried by the right female rotor 46. As these chambers turn into each other, they are reduced in size until they reach a point near the lower right corner of the profile of male rotor 42 and lower left comer of the profile of right female rotor 46, at which point the chambers reach an opening in an end-plate 104 as seen in FIG. 11, and the compressed fluid is exhausted to the downstream or high pressure side of the compressor.

Thus, it can be seen that male rotor 42 interfaces and interacts with female rotors 44 and 46 to form closed rotating working chambers to compress a fluid, the working chambers reducing in volume as the rotors rotate to compress the working fluid.

While the above described embodiment has been described with a male rotor having eight lobes, whereby eight discharge pulses per revolution of the male rotor are generated for each of the female rotor for a total of sixteen pulses per revolution, it may be preferred that a male rotor having nine lobes (i.e., an odd number) be employed. The sixteen pulses per revolution actually only generate eight pulses per revolution, since two pulses occur at the same time, i.e., one for each of the female rotors. With a male rotor having nine lobes, eighteen pulses per revolution are generated, i.e., nine pulses per revolution for each of the two female rotors. However, none of these eighteen pulses occur during another one of the pulses, thereby generating a more even or smoother discharge flow, i.e., less noise.

Figure 8:
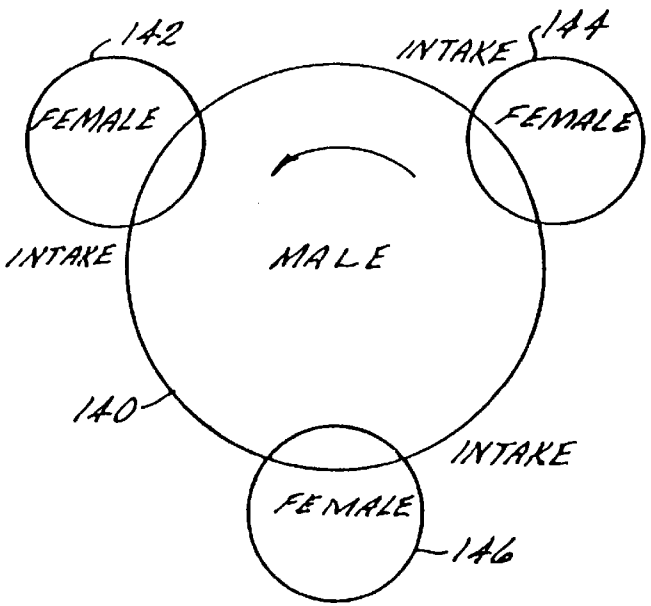
FIG. 8 is a diagrammatic cross sectional view of a multi-rotor configuration in accordance with an alternate embodiment of the present invention.

Further, while the above described embodiment has been described with only two female rotors, it is within the scope of the present invention that two or more female rotors may be employed with a single drive male rotor. Referring to FIG. 8, a cross sectional view of a male rotor 140 is axially aligned with and in communication with three equally spaced female rotors 142, 144 and 146. Male rotor 140 is driven by a motor, as described above. In this example, male rotor 140 has between ten and twenty lobes (e.g., twelve lobes would have a 100° wrap), female rotor 142 has between four and seven flutes (e.g., six flutes would have 200° wrap), female rotor 144 has between four and seven flutes (e.g., six flutes would have 200° wrap), and female rotor 146 has between four and seven flutes (e.g., six flutes would have 200° wrap). The male lobe wrap angle S° can easily be determined from the female flute wrap angle P°, the number of female flutes Z, and the number of male lobes X by the following formula:

$$S^\circ = P^\circ Z/X$$

Similarly, for any given male lobe wrap angle S°, the female flute wrap angle P° can be determined from the formula:

$$P^\circ = S^\circ X/Z$$

Again, where the pitch diameters of the female rotors 142, 144, 146 are less than the pitch diameter of the male rotor 140. In all cases, the wrap angle of the male lobes is preferably less than 360°, and the wrap angle of the female flutes is always less than 360°. Referring to Table 1 the relationship between wrap angles is illustrated for various commercial combinations as discussed herein above. The comparison made in Table 1 is between a twin rotor of the prior art having a male wrap angle of 300° and various multi-rotor configurations in accordance with the present invention. An important aspect of the present invention is that the male wrap angle S° of the multi-rotor compressor is equal to that of a twin rotor compressor divided by the number of female rotors Y. For example, in Table 1 male wrap angle S° for two female rotors is 150° and S° for three female rotors is 100°. The wrap angle of the female rotor for many combinations of rotor attributes are shown in Tables 1 and can be determined in accordance with the formula given above. This relationship holds for any male rotor wrap angles. The relationships for male wrap angle S° equal to 360° divided by the number of female rotors is shown in Table 2.

TABLE 1

Degree of Wrap for Female Rotors for male rotors having 300°/Y Degrees of wrap for various Lobe-flute Combinations

| -Y- No. of Female Rotors | -Z- No of Female Flutes | -X- Number of Male Lobes 4 | 5 | 6 |
|---|---|---|---|---|
| 1 | 5 | 240 | 300 | 360 |
| | 6 | 200 | 250 | 300 |
| | 7 | 171 | 214 | 257 |

| -Y- | -Z- | -X- 8 | 9 | 10 | 11 | 12 |
|---|---|---|---|---|---|---|
| 2 | 5 | 240 | 270 | 300 | 330 | 360 |
| | 6 | 200 | 225 | 250 | 275 | 300 |
| | 7 | 171 | 193 | 214 | 236 | 257 |

| -Y- | -Z- | -X- 12 | 13 | 14 | 15 | 16 | 17 | 18 |
|---|---|---|---|---|---|---|---|---|
| 3 | 5 | 240 | 260 | 280 | 300 | 320 | 340 | 360 |
| | 6 | 200 | 217 | 233 | 250 | 267 | 283 | 300 |
| | 7 | 171 | 186 | 200 | 214 | 229 | 243 | 257 |

TABLE 2

Degree of Wrap of Female Rotors for male rotors having 360°/Y Degrees of Wrap for various Lobe-flute Combinations

| -Y- of Female Rotors | -Z- No of Female Flutes | -X- Number of Male Lobes 4 | 5 | 6 |
|---|---|---|---|---|
| 1 | 5 | 288 | 360 | * |
| | 6 | 240 | 300 | 360 |
| | 7 | 206 | 257 | 309 |

| -Y- | -Z- | -X- 8 | 9 | 10 | 11 | 12 |
|---|---|---|---|---|---|---|
| 2 | 5 | 288 | 324 | 360 | * | * |
| | 6 | 240 | 270 | 300 | 330 | 360 |
| | 7 | 206 | 231 | 257 | 283 | 309 |

| -Y- | -Z- | -X- 12 | 13 | 14 | 15 | 16 | 17 | 18 |
|---|---|---|---|---|---|---|---|---|
| 3 | 5 | 288 | 312 | 336 | 360 | * | * | * |
| | 6 | 240 | 260 | 280 | 300 | 320 | 340 | 360 |
| | 7 | 206 | 223 | 240 | 257 | 274 | 291 | 309 |

*This combination yields a wrap angle greater than 360°.

The present invention further comprises a myriad of combinations between the number of female rotors, the number of flutes on the female rotors, and the number of lobes on the male rotor with each combination yielding different operating parameters such as noise, pumping capacity, rotational speed, discharge flow, etc. Table 1 illustrates many of the commercially viable combinations of lobes on the male rotor X, number of female rotors Y, and number of flutes Z on the female rotor with comparison to the prior art twin rotor configuration where Y=1. The first example given above is found in Table 1 for a male rotor having eight lobes, X=8, two female rotors, Y=2, and each female rotor having 6 flutes, Z=6. The second example is shown in the next column for a male rotor having nine lobes. As illustrated by Table 1 a relationship exists between a twin rotor configuration Y=1, a tri-rotor configuration Y=2, and a four rotor configuration Y=3. It can be seen from the examples given above and shown in Table 1 that the various combinations of rotor attributes with regard to an increase in the number of female rotors from $Y_1$ to $Y_2$ is governed by the following formula:

$$X_2=(Y_2/Y_1)X_1\pm N/Y_1$$

where the number of lobes on the male rotor increases from $X_1$ to $X_2$ and where N is an integer ranging from 0 to $(Y_2-1)$.

It will be appreciated that certain geometrical and operational relationships are established in accordance with the present invention. For instance, the diameter of the male rotor increases with an increase in the number of female rotors as described herein above. The increase in diameter of the male rotor increases the stiffness of the rotor and increases the rotational speed of the female rotors thereby increasing the output capacity of the compressor. With reference back to FIG. 4, pitch diameter (PD) 72 of male rotor 42 increases in relation to the increase in the number of female rotors. If the pitch diameter 68, 70 of the female rotors 44, 46 remains constant the increase in the male rotor pitch diameter is expressed in accordance with the following formula:

$$PD_2=PD_1(Y_2/Y_1)$$

where the number of female rotors increases from $Y_1$ to $Y_2$.

It will be appreciated that the output capacity of a compressor, having a constant rotational speed of the male rotor and essentially identical female rotors, increases as the number of female rotors increases. In accordance with the present invention the output capacity C of compressor increases as the number of female rotors increases from $Y_1$ to Y2 in conformity with the following formula:

$$C=Y_2^2$$

Also, while the above example has been directed to a compressor for HVAC use, the multi-rotor configuration of the present invention is equally applicable in other helical type compressors, e.g., compressors with working fluids such as helium, air and ammonia. Moreover, the multi-rotor compressor of the present invention may be extremely well suited for oil less air compression.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A helical screw rotary compressor comprising:

a housing having an inlet and a discharge;

a first rotor in said housing and rotatable about a first axis;

a second rotor in said housing and rotatable about a second axis parallel to said first axis;

at least a third rotor in said housing and rotatable about a third axis parallel to said first axis;

said second and third rotors being driven by said first rotor, and said first rotor interfacing and interacting with said second and third rotors to form rotating working chambers to compress a fluid having liquid droplets of said fluid entrained therein, said liquid droplets being introduced into said compressor with said fluid at or near said inlet, and said liquid droplets being the primary source of lubrication of the interfaces between said first rotor and each of said second and third rotors.

2. The helical screw rotary compressor as in claim 1 wherein:

said first rotor is a male rotor having a plurality of lobes on the outer surface with a degree of wrap; and each of said second and third rotors is a female rotor having a plurality of flutes for mating with said lobes, said flutes having a degree of wrap.

3. The helical screw rotary compressor as in claim 2 wherein:

each of said first, second and third rotors has a pitch circle, the pitch circle of said male rotor being greater than the pitch circles of said female rotors, and the pitch circles of said female rotors being equal.

4. The helical screw rotary compressor as in claim 2 wherein said male rotor comprises:

a generally cylindrical inner metal shaft; and an outer ring of composite material mounted directly on and rotatable with said inner shaft, said outer ring including said male lobes.

5. The helical screw rotary compressor of claim 4 wherein:

the radius R of said inner metal shaft is less than the radius of the pitch circle of said male rotor;

the thickness of said ring of composite material from said pitch circle to the inner diameter of said composite ring is $L_1$;

the thickness of said ring of composite material from said pitch circle to the tip of each lobe is $L_2$; and $L_1$ is at least 0.5 $L_2$.

6. The helical screw rotary compressor of claim 5 wherein:

$L_1=L_2$.

7. The helical screw rotary compressor of claim 5 wherein:

R is at least equal to $L_1+L_2$.

8. The helical screw rotary compressor of claim 5 wherein:

the maximum value of R is 1.67 $(L_1+L_2)$, where $L_1$ is 0.5 $L_2$.

9. The helical screw rotary compressor of claim 3 wherein:

the total number of rotors is three, one male rotor and two female rotors; and said male rotor has eight lobes; and each of said female rotors has five, six or seven flutes.

10. The helical screw rotary compressor of claim 3 wherein:

the total number of rotors is three, comprised of one male rotor and two female rotors; and said male rotor has ten lobes; and each of said female rotors has five, six or seven flutes.

11. The helical screw rotary compressor of claim 3 wherein:

the total number of rotors is four, comprised of one mate rotor and three female rotors; and said male rotor has twelve lobes; and each of said female rotors has five, six or seven flutes.

12. The helical screw rotary compressor of claim 3 wherein:

the total number of rotors is four, comprised of one male rotor and three female rotors; and said male rotor has fifteen lobes; and each of said female rotor has seven flutes.

13. The helical screw rotary compressor of claim 3 wherein:

the total number of rotors is five, comprised of one male rotor and four female rotors; and said male rotor has 16 lobes; and each of said female rotors has six flutes.

14. The helical screw rotary compressor of claim 3 wherein:

the total number of rotors is five, comprised of one male rotor and four female rotors; and said male rotor has 20 lobes; and each of said female rotors has 7 flutes.

15. The helical screw rotary compressor as in claim 3 wherein the compressor has:

one male rotor having X lobes, where X is at least eight; and

Y female rotors, each having Z flutes, where Z is at least five.

16. The helical screw rotary compressor as in claim 15 wherein:

the number of female rotors, Y, is two.

17. The helical screw rotary compressor as in claim 15 wherein:

X is nine or ten, eleven or twelve;

Y is 2; and

Z is at least five.

18. The helical screw rotary compressor as in claim 15 wherein:

X is 12;

Y is 3; and

Z is at least five.

19. The helical screw rotary compressor as in claim 15 wherein:

X is 15;

Y is 3; and

Z is at least five.

20. The helical screw rotary compressor as in claim 15 wherein:

for each increase in Y from $Y_1$ to $Y_2$ the number of lobes X increases from $X_1$ to $X_2$ in accordance with the formula:

$$X_2=(Y_2/Y_1)X_1\pm N/Y_1$$

and where N is an integer from 0 to $(Y_2-1)$.

21. The helical screw rotary compressor as in claim 20 wherein:

with all female rotors being of the same pitch diameter and having the same L/D ratio, where L is axial length and D is crest diameter, the pitch diameter (PD) of the male rotor increases as a function of an increase in female rotors from $Y_1$ to $Y_2$ in accordance with the formula $$PD_2=PD_1(Y_2/Y_1) \text{ where}$$

$PD_2$=the pitch diameter of a male rotor having $Y_2$ female rotors; and $PD_1$=the pitch diameter of a male rotor having $Y_1$ rotors.

22. The helical screw rotary compressor as in claim 3 wherein:

for a constant rotational speed of said male rotor for an increase in number of essentially identical female rotors from $Y_1$ to $Y_2$, the pumping capacity of the compressor increases in accordance with the formula $$C=y_2^2$$

relative to the capacity of a compressor having $Y_1$ rotors.

23. The helical rotary screw compressor as in claim 2 wherein the degree of wrap of the flute P is in accordance with the formula $$P=S\ X/Z$$

where S is the degree of wrap of the lobes, where X is the number of lobes, and where Z is the number of flutes.

24. A helical screw rotary compressor comprising:

a housing;

a first rotor in said housing and rotatable about a first axis;

a second rotor in said housing and rotatable about a second axis parallel to said first axis;

at least a third rotor in said housing and rotatable about a third axis parallel to said first axis;

said second and third rotors being directly driven by said first rotor, and said first rotor interfacing and interacting with said second and third rotors to form rotating working chambers, said working chambers being reduced in volume as said rotors rotate to compress a working fluid; and a discharge plate disposed at an outlet end of said compressor, said discharge plate having an axial discharge port in communication with each of said working chambers.

25. The helical screw rotary compressor of claim 24 wherein:

said first rotor is a male rotor having a plurality of lobes on the outer surface with a degree of wrap; and each of said second and third rotors is a female rotor having a plurality of flutes for mating with said lobes, said flutes having a degree of wrap.

26. The helical screw rotary compressor as in claim 25 wherein:

each of said first, second and third rotors has a pitch circle, and the pitch of said male rotor being greater than the pitch circles of said female rotors, and the pitch circles of said female rotors being equal.

27. The helical screw rotary compressor as in claim 25 wherein: said male rotor comprises:

a generally cylindrical inner metal shaft; and an outer ring of composite material mounted directly on and rotatable with said inner shaft, said outer ring including said male lobes.

28. The helical screw rotary compressor as in claim 27 wherein:

the total number of rotors is three, one male rotor and two female rotors; and said male rotor has eight lobes; and each of said female rotors has five, six or seven flutes.

29. The helical screw rotary compressor of claim 27 wherein:

the total number of rotors is three, comprised of one male rotor and two female rotors; and said male rotor has ten lobes; and each of said female rotors has five, six or seven flutes.

30. The helical screw rotary compressor of claim 27 wherein:

the total number of rotors is four, comprised of one male rotor and three female rotors; and said male rotor has twelve lobes; and each of said female rotors has five, six or seven flutes.

31. The helical screw rotary compressor of claim 27 wherein:

the total number of rotors is four, comprised of one male rotor and three female rotors; and said male rotor has fifteen lobes; and each of said female rotors has seven flutes.

32. The helical screw rotary compressor of claim 27 wherein:

the total number of rotors is five, comprised of one male rotor and four female rotors; and said male rotor has 16 lobes; and each of said female rotors has six flutes.

33. The helical screw rotary compressor of claim 27 wherein:

the total number of rotors is five, comprised of one male rotor and four female rotors; and said male rotor has 20 lobes; and each of said female rotors has 7 flutes.

34. The helical screw rotary compressor as in claim 25 wherein the degree of wrap of each flute P of each female rotor is in accordance with the formula:

$$P=S\ X/Z$$

where S is the degree of wrap of the lobes of the male rotor where X is the number of lobes of the male rotor, and where Z is the number of flutes of the female rotor.

* * * * *